US006386902B2

(12) United States Patent
Nagayasu

(10) Patent No.: US 6,386,902 B2
(45) Date of Patent: May 14, 2002

(54) TERMINAL PROTECTION CAP

(75) Inventor: Daiki Nagayasu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 101 days.

(21) Appl. No.: 09/728,108

(22) Filed: Dec. 1, 2000

(30) Foreign Application Priority Data

Dec. 2, 1999 (JP) ..... 11-343607

(51) Int. Cl.[7] ..... H01R 13/44; H01R 13/52
(52) U.S. Cl. ..... 439/447; 439/125; 439/522
(58) Field of Search ..... 439/521, 522, 439/125–128, 519, 588, 592, 447

(56) References Cited

U.S. PATENT DOCUMENTS 878,551 A * 2/1908 Mills ..... 439/125
4,921,443 A 5/1990 Sato ..... 439/521
4,952,171 A 8/1990 Sugiyama ..... 439/522
4,997,380 A * 3/1991 Etienne et al. ..... 439/127

* cited by examiner

*Primary Examiner*—Renee Luebke
*Assistant Examiner*—Felix D. Figueroa
(74) *Attorney, Agent, or Firm*—Anthony J. Casella; Gerald E. Hespos

(57) ABSTRACT

A hollow tubular part (14) constituting a part of a terminal protection cap (11) has a cap part (13) and a large-diameter portion (15) located adjacent the cap part (13). A tapered portion (16) is continuous with the large-diameter portion (15); and a small-diameter portion (17) is continuous with the tapered portion (16). The thickness of the tapered portion (16) and the thickness of the end of the small-diameter portion (17) adjacent the tapered portion (16) are smaller than the thickness of the large-diameter portion (15) and the thickness of sections of the small-diameter portion (17) further from the tapered portion (16).

19 Claims, 4 Drawing Sheets

TERMINAL PROTECTION CAP

BACKGROUND OF THE INVENTION

1. Field of the Invention

The present invention relates to a protection cap and more particularly to a protection cap capable of protecting a terminal of an electric wire installed on a starter motor or the like of a vehicle.

2. Description of the Related Art

Electric devices mounted on a vehicle body are connected to electric wires. Some electric devices, such as an alternator (ACG), have a high voltage and a high temperature. Therefore, a terminal of the electric wire connected with the alternator is covered with a protection cap in consideration of interference with peripheral devices, influence of heat transmitted from the alternator, penetration of water, and the like.

FIG. 3 shows an example of the conventional protection cap of this kind. Referring to FIG. 3, reference numeral 1 denotes an electric wire. A terminal 2 is provided at an end of the electric wire 1. The terminal 2 is connected to an unshown alternator or the like.

The terminal 2 is covered with a semispherical cap. 3 made of an elastic material, such as rubber. A hollow cylindrical part 3*a* is formed continuously with the cap 3. The terminal 2 is passed through the hollow cylindrical part 3*a* and is inserted into or through the cap 3.

A cylindrical rubber cover 4 is provided on the hollow cylindrical part 3*a*. The rubber cover 4 is fixed to the electric wire 1 by tape 5 to protect the electric wire 1 in the vicinity of the terminal 2.

The electric wire 1 is delivered to a user, with the cap 3 shifted toward the rubber cover 4 and with the terminal bare, as shown in FIG. 3A. The terminal 2 is installed on the alternator with a bolt, and the cap 3 then is shifted toward the terminal 2 to cover the terminal 2 with the cap 3.

As described above, the electric wire 1 is delivered to the user, with the cap 3 shifted toward the rubber cover 4 and with the terminal 2 bare. Thus, the terminal 2 can be installed on the electric wire 1 with high operability.

However, in the conventional cap 3, after the terminal 2 is installed on the alternator, the cap 3 is shifted toward the terminal 2. Thus, an end portion of the electric wire 1 at the side of the terminal 2 is exposed and not protected.

To solve the above-described problem, the dimension of the rubber cover 4 is altered and the cap 3 is delivered to the user with the cap 3 connected with the rubber cover 4, as shown in FIG. 4. The illustrated assembly of the electric wire 1, the terminal 2, the cap 3 and the rubber cover 4 can be installed on the alternator by shifting the cap 3 and the rubber cover 4 from the terminal 2 and then folding the cap 3 toward the rubber cover 4. Then, the terminal 2 is installed on the bolt 6 of the alternator 7 with the terminal 2 exposed. Next, as shown in FIG. 4C, the cap 3 and the rubber cover 4 are shifted toward the terminal 2, and the cap 3 is folded back toward the terminal 2 to cover the terminal with the cap 3.

The conventional protection cap shown in FIG. 4 first requires the cap 3 and the rubber cover 4 to be shifted from the terminal 2, then requires the cap 3 to be folded toward the rubber cover 4 and finally requires the cap 3 to be folded back toward the terminal 2. In addition, the cap 3 cannot be folded easily in either direction. Thus, the electric wire-installing work takes time and labor.

The present invention has been made in view of the above-described problem. Thus, it is an object of the present invention to provide a terminal protection cap having a construction allowing a terminal to be exposed easily and protected to perform a terminal-installing work with high operability.

SUMMARY OF THE INVENTION

The subject invention is directed to a terminal protection cap for protecting a terminal provided at an end of an electric wire. The terminal protection cap comprises a cap part configured for covering the terminal directly and a hollow tubular part integral with the cap part. The hollow tubular part allows the terminal to be inserted into the cap part in penetration therethrough. The hollow tubular part has a large-diameter portion located at the side of the cap part; a tapered portion continuous with the large-diameter portion; and a small-diameter portion continuous with the tapered portion. The tapered portion and the section of the small-diameter portion adjacent the tapered portion have walls that are thinner than the walls of both the large-diameter portion and sections of the small-diameter portion remote from the tapered portion.

With this construction, the cap part is slid toward the small-diameter portion with respect to the thin tapered portion and the end of the small-diameter portion at the side of the tapered portion. The cap then is bent. Thus, it is easy to expose the terminal, and it is easy to install the terminal on an alternator or the like. After the terminal is installed, the cap part is slid toward the terminal with respect to the thin tapered portion and the end of the small-diameter portion at the side of the tapered portion, and thus the cap is returned to its original state. In this manner, the terminal can be protected by the cap part. That is, it is possible to perform the terminal-installing work with high operability.

DETAILED DESCRIPTION OF THE PREFERRED EMBODIMENTS

Figure 1A:
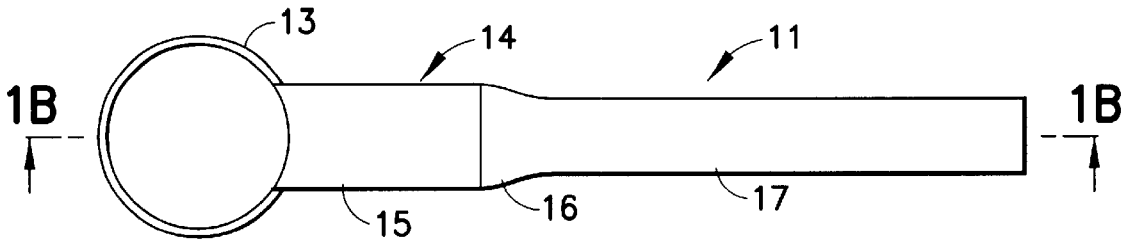
FIG. 1A is a plan view showing an embodiment of the terminal protection cap of the present invention.
Figure 1B:
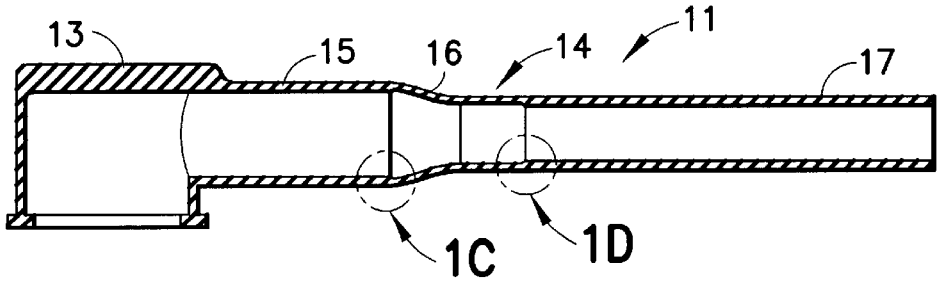
FIG. 1B is a sectional view taken along a line A—A of FIG. 1A.

A terminal protection cap in accordance with the subject invention is identified generally by the numeral 11 in FIGS.

1 and 2. The terminal protection cap 11 has a semispherical cap part 13 directly covering a terminal 12*a* of an electric wire 12. A hollow tubular part 14 is integral with the cap part 13 and allows the terminal 12*a* to be inserted into the cap part 13 in penetration therethrough.

The hollow tubular part 14 has a large-diameter portion 15 located at the side of the cap part 13; a tapered portion 16 continuous with the large-diameter portion 15; and a small-diameter portion 17 continuous with the tapered portion 16. The tapered portion 16 and the end of the small-diameter portion 17 adjacent the tapered portion 16 have walls with a thickness that is less than the wall thickness of the large-diameter portion 15 and sections of the small-diameter portion 17 spaced further from the tapered portion 16. More specifically, in the illustrated embodiment, the thickness of the large-diameter portion 15 and most of the small-diameter portion 17 are set to 1.5 mm. However, the end of the small-diameter portion 17 at the side of the tapered portion 16 is set to 1.0 mm. Reference numeral 19 in FIG. 2 denotes a tape to be fixed to the electric wire 12.

Figure 2A:
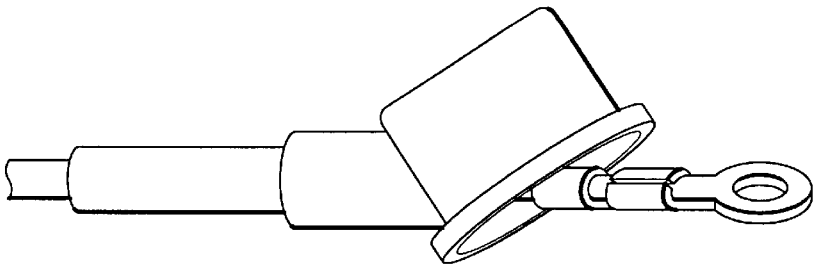
FIG. 2A shows a specification used to install a cap of an embodiment of the present invention on an electric wire.
Figure 2B:
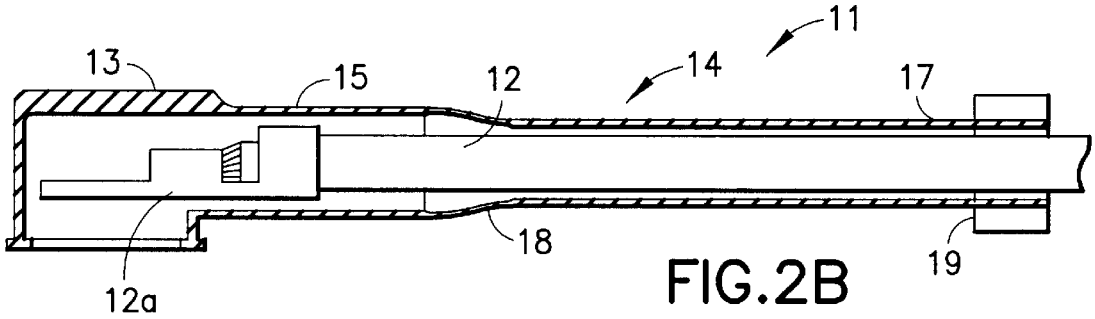
FIG. 2B is a sectional view showing the terminal protection cap whose cap part covers a terminal.
Figure 2C:
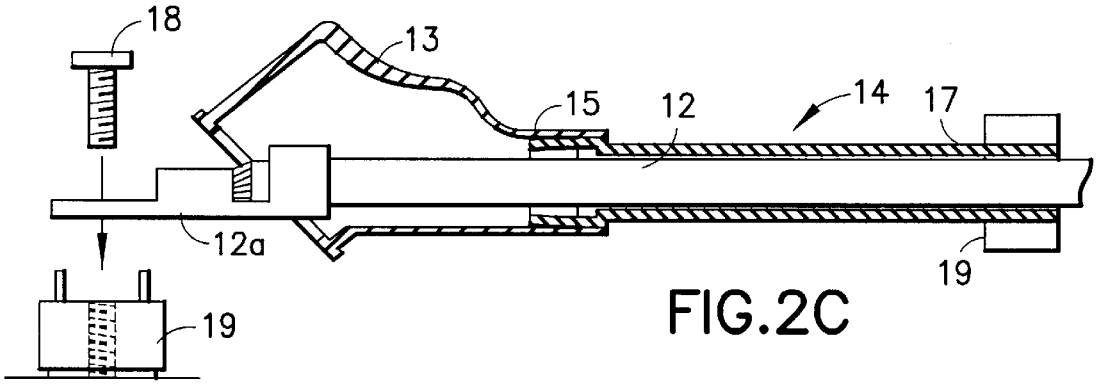
FIG. 2C is a sectional view showing the terminal protection cap whose cap part is bent.
Figure 3A:
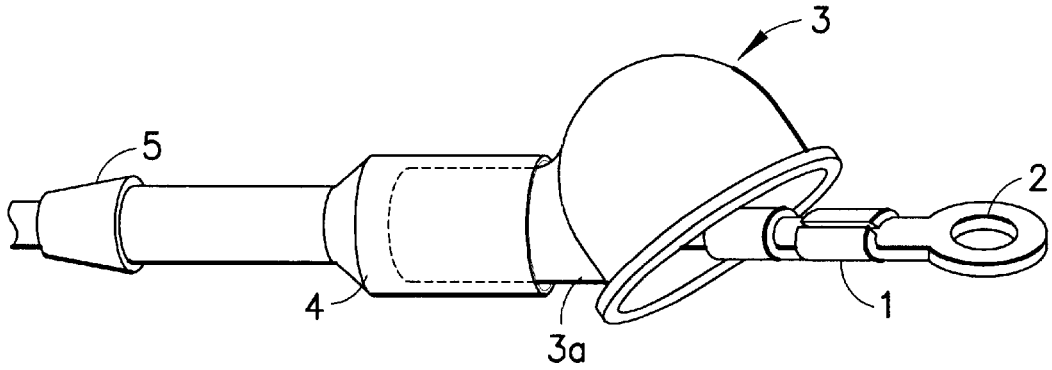
FIG.3A PRIOR ART
FIG. 3A shows the outlook of a conventional terminal protection cap whose cap part is located at a position in which a terminal is exposed in a cap part of the terminal protection cap.
Figure 3B:
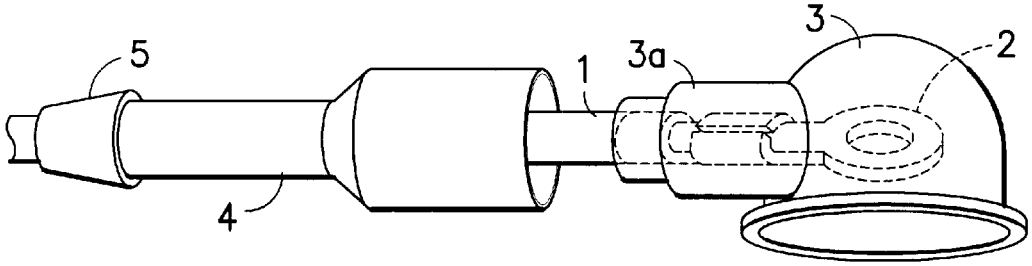
FIG.3B PRIOR ART
FIG. 3B shows the outlook of the conventional terminal protection cap in a state in which the terminal is installed on an alternator.
Figure 4A:
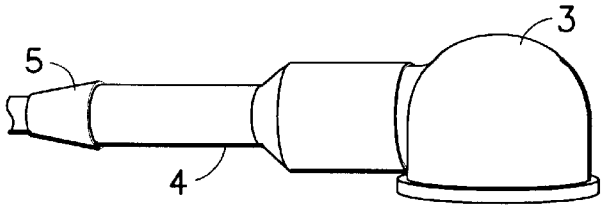
FIG.4A PRIOR ART
FIGS. 4A–C shows the procedure of installing a terminal of an electric wire on which another conventional terminal protection cap is installed.
Figure 4B:
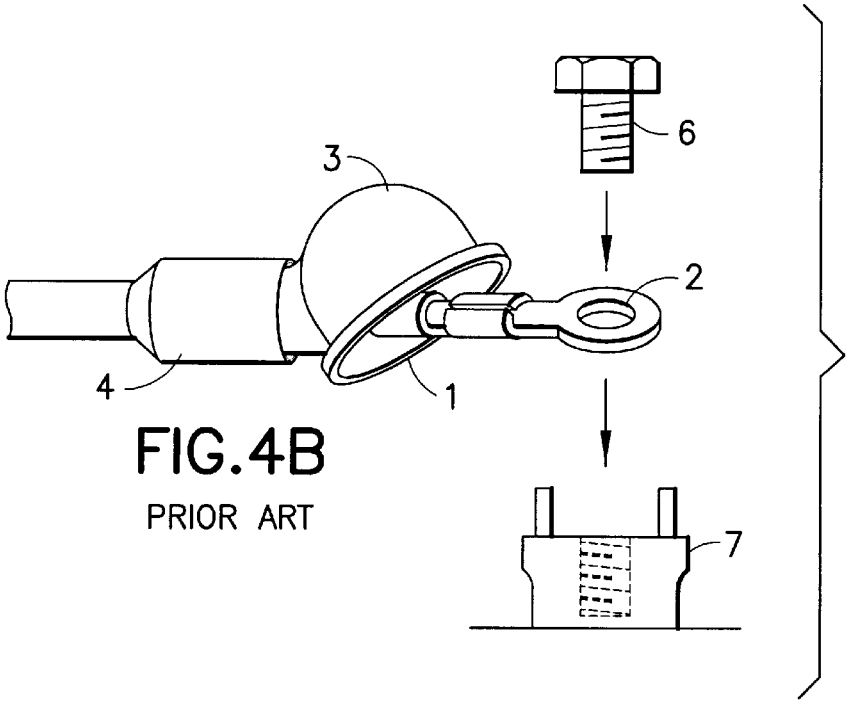
FIG.4B PRIOR ART
Figure 4C:
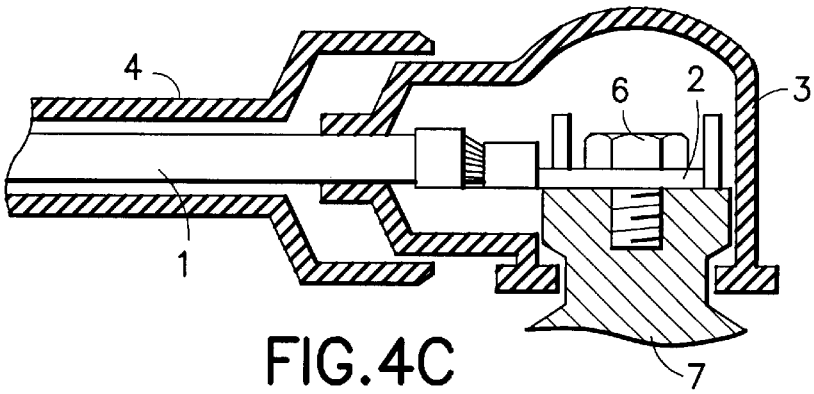
FIG.4C PRIOR ART

With reference to FIG. 2A, the assembly of the protection cap 11 and the electric wire 12 are installed on an alternator by first sliding the cap part 13 toward the small-diameter portion 17 with respect to both the thin tapered portion 16 and the end of the small-diameter portion 17 adjacent the tapered portion 16. The cap part 13 then is bent. In this case, as shown in FIG. 2C, the thin tapered portion 16 and the end of the small-diameter portion 17 at the side of the tapered portion 16 deform and overlap on each other. As a result, the terminal 12*a* is exposed.

In this state, the terminal 12*a* is installed on an alternator 20 with a bolt 18. Then, the cap part 13 is slid toward the terminal 12*a* with respect to the thin tapered portion 16 and the end of the small-diameter portion 17 at the side of the tapered portion 16 and returned to its original state. In manner, the terminal 12*a* can be protected by the cap part 13.

As described above, the large-diameter portion 15 of the hollow tubular part 14 that constitutes part of the cap 11 is located at the side of the cap part 13. Additionally, the tapered portion 16 is continuous with the large-diameter portion 15 and the small-diameter portion 17 is continuous with the tapered portion 16. The thickness of the tapered portion 16 and that of the end of the small-diameter portion 17 at the side of the tapered portion 16 are smaller than the thickness of the large-diameter portion 15 and the small-diameter portion 17 further from the tapered portion 16. Therefore, the cap 13 can be bent easily and returned to its original state. Thus, the cap 13 allows the terminal-installing work to be done with high operability.

Figure 1C:
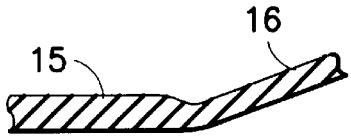
FIG. 1C is an enlarged view showing a portion B of FIG. 1B.
Figure 1D:
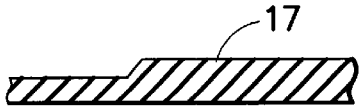
FIG. 1D is an enlarged view showing a portion C of FIG. 1B.
Figure 1E:
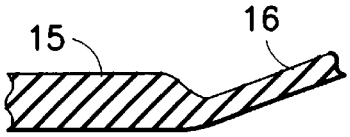
FIG. 1E is an enlarged view similar to FIG. 1C, but showing a greater thickness for the large diameter portion of the hollow tubular part.

In the illustrated embodiment of FIG. 1C the thickness of the large-diameter portion 15 is substantially equal to the thickness of sections of the small-diameter portion 17 remote from the tapered portion 16. However, the thickness of the large-diameter portion 15 may be different from the thickness of the sections of the small-diameter portion 17 further from the tapered portion 16, as shown in FIG. 1E. In particular, a larger difference between the thickness of the large-diameter portion 15 and that of the small-diameter portion 17 enables the cap part 13 to be slid more easily.

The construction according to the invention allows a terminal to be exposed easily and protected. Thus, it is possible to perform the terminal-installing work with high operability.

What is claimed is:

1. A terminal protection cap for protecting a terminal at an end of an electric wire, the terminal and the electric wire each having selected cross sectional dimensions, comprising:

a cap part having an interior cross sectionally larger than both the terminal and the electric wire and configured for covering said terminal directly; and a hollow tubular part integral with said cap part and having a large-diameter portion located adjacent said cap part, a tapered portion continuous with said large-diameter portion and a small-diameter portion continuous with said tapered portion, said large-diameter portion of said hollow tubular part having an interior that is cross sectionally larger than the cross sectional dimensions of said terminal and said electric wire such that said large-diameter portion of said hollow tubular part and said cap part adjacent said large diameter portion both are axially movable along said electric wire and away from said terminal, said small diameter portion of said hollow tubular part having interior cross sectional dimensions sufficiently small for engagement with said electric wire; and said tapered portion and sections of said small-diameter portion adjacent said tapered portion having wall thicknesses less than wall thicknesses of said large-diameter portion and sections of said small-diameter portion spaced from the tapered portion.

2. The terminal protection cap of claim 1, wherein the cap part and the hollow tubular part are unitary with one another.

3. The terminal protection cap of claim 2, wherein the terminal protection cap is unitarily formed from rubber.

4. The terminal protection cap of claim 2, wherein the large diameter portion has a wall thickness at least 50% greater than the wall thickness of the tapered portion and a section of the small diameter portion adjacent the tapered portion.

5. The terminal protection cap of claim 4, wherein the large diameter portion has a wall thickness substantially equal to the wall thickness of sections of the small diameter portion remote from the tapered portion.

6. The terminal protection cap of claim 4, wherein the large diameter portion has a wall thickness greater than the wall thickness at all other locations on the hollow tubular part.

7. The terminal protection cap of claim 4, wherein the large diameter portion has a wall thickness of 1.5 mm.

8. The terminal protection cap of claim 7, wherein the tapered portion and the sections of the small diameter portion adjacent the tapered portion have a wall thickness of 1.0 mm.

9. The terminal protection cap of claim 1, wherein the tapered portion and the sections of the small diameter portion adjacent the tapered portion have sufficiently thin walls to be folded over the section of the small diameter portion with a thick wall in response to pushing forces exerted on the large diameter portion.

10. A terminal protection cap for protecting a terminal at an end of an electric wire, the terminal and the electric wire each having selected cross sectional dimensions, comprising:

a cap part having an interior cross sectionally larger than both the terminal and the electric wire and configured for covering said terminal directly; and a hollow tubular part integral with said cap part and dimensioned for permitting said terminal to be inserted through said hollow tubular part and into said cap part, said hollow tubular part having a first end portion adjacent said cap part and a second end portion spaced from said first end portion, said first and second end portions each having a selected wall thickness, said hollow tubular part further having an intermediate portion extending continuously between the first and second end portions, said intermediate portion having a wall thickness less than the wall thicknesses of said first and second end portions, said first end portion of said hollow tubular part being cross sectionally larger than said cross sectional dimensions defined by said terminal and said electric wire such that said cap part and said first end portion of said hollow tubular part are movable axially along said electric wire and away from said terminal, said second end portion of said hollow tubular part having an interior that is cross sectionally dimensioned for engagement with said wire.

11. The terminal protection cap of claim 10, wherein the cap part and the hollow tubular part are unitary with one another.

12. The terminal protection cap of claim 11, wherein the terminal protection cap is unitarily formed from rubber.

13. The terminal protection cap of claim 11, wherein the first end portion has a wall thickness at least 50% greater than the wall thickness of the intermediate portion.

14. The terminal protection cap of claim 13, wherein the first end portion has a wall thickness approximately equal to the wall thickness of sections of the second end portion remote from the intermediate portion.

15. The terminal protection cap of claim 13, wherein the first end portion has a wall thickness greater than the wall thickness at all other locations on the hollow tubular part.

16. The terminal protection cap of claim 13, wherein the first end portion has a wall thickness of 1.5 mm.

17. The terminal protection cap of claim 16, wherein the intermediate portion and the sections of the second end portion adjacent the intermediate portion have a wall thickness of 1.0 mm.

18. The terminal protection cap of claim 10, wherein the intermediate portion and the sections of the second end portion adjacent the intermediate portion have sufficiently thin walls to be folded over the section of the second end portion with a thick wall in response to pushing forces exerted on the first end portion.

19. The terminal protection cap of claim 10, wherein the first and second end portions each are substantially cylindrical and define selected diameters, the diameter of the first end portion being greater than the diameter of the second end portion.

* * * * *